US009144876B2

(12) United States Patent
Shibata et al.

(10) Patent No.: US 9,144,876 B2
(45) Date of Patent: Sep. 29, 2015

(54) EYEGLASS LENS PROCESSING APPARATUS

(71) Applicant: NIDEK CO., LTD., Gamagori, Aichi (JP)

(72) Inventors: Ryoji Shibata, Toyokawa (JP); Toshiaki Asaoka, Gamagori (JP); Yoshiaki Kamiya, Nagoya (JP); Shinji Koike, Okazaki (JP)

(73) Assignee: NIDEK CO., LTD., Aichi (JP)

( * ) Notice: Subject to any disclaimer, the term of this patent is extended or adjusted under 35 U.S.C. 154(b) by 0 days.

(21) Appl. No.: 14/156,819

(22) Filed: Jan. 16, 2014

(65) Prior Publication Data

US 2014/0199917 A1 Jul. 17, 2014

(30) Foreign Application Priority Data

Jan. 17, 2013 (JP) ..... 2013-006094

(51) Int. Cl.
*B24B 9/14* (2006.01)
*B24B 49/00* (2012.01)
*B24B 49/16* (2006.01)

(52) U.S. Cl.
CPC ..... *B24B 9/148* (2013.01); *B24B 49/00* (2013.01); *B24B 49/16* (2013.01)

(58) Field of Classification Search
CPC ..... B24B 49/00; B24B 49/16; B24B 51/00; B24B 9/14; B24B 9/148
USPC ..... 451/5, 10, 11, 43, 69, 70, 242, 246, 256
See application file for complete search history.

(56) References Cited

U.S. PATENT DOCUMENTS

| | | | | |
|---|---|---|---|---|
| 6,220,929 | B1 * | 4/2001 | Mizuno | 451/5 |
| 6,859,336 | B1 * | 2/2005 | Wada et al. | 359/819 |
| 8,235,770 | B2 * | 8/2012 | Obayashi | 451/43 |
| 8,241,091 | B2 * | 8/2012 | Takeichi | 451/5 |
| 8,260,451 | B2 * | 9/2012 | Takeichi | 700/164 |
| 2002/0115381 | A1 | 8/2002 | Mizuno et al. | |
| 2004/0192170 | A1 | 9/2004 | Mizun | |
| 2005/0107002 | A1 * | 5/2005 | Gottschald et al. | 451/8 |
| 2008/0248722 | A1 * | 10/2008 | Takeichi | 451/5 |
| 2009/0104848 | A1 * | 4/2009 | Meunier et al. | 451/9 |
| 2009/0176442 | A1 * | 7/2009 | Takeichi et al. | 451/8 |
| 2010/0197198 | A1 * | 8/2010 | Takeichi | 451/5 |
| 2010/0248590 | A1 * | 9/2010 | Shibata et al. | 451/5 |
| 2010/0311310 | A1 * | 12/2010 | Takeichi | 451/5 |

FOREIGN PATENT DOCUMENTS

| | | | |
|---|---|---|---|
| JP | 2002-205251 A | | 7/2002 |
| JP | 2004-255561 A | | 9/2004 |
| JP | 2010094795 A | * | 4/2010 |

* cited by examiner

*Primary Examiner* — Eileen Morgan
(74) *Attorney, Agent, or Firm* — Sughrue Mion, PLLC

(57) ABSTRACT

An eyeglass lens processing apparatus includes: a lens rotation unit configured to rotate a lens chuck shaft; a processing tool rotational shaft to which a processing tool is attached; a shaft-to-shaft distance change unit that includes a carriage which holds the lens chuck shaft or the processing tool rotational shaft and is movable in a direction where a shaft-to-shaft distance between the lens chuck shaft and the processing tool rotational shaft changes by driving a motor, a movement member that is moved in the shaft-to-shaft distance direction, a connection member that connects the movement member and the carriage, and a deformation detecting sensor configured to detect a deformation of the connection member; and a controller configured to control the driving of the motor based on a detection result of the deformation detecting sensor.

7 Claims, 5 Drawing Sheets

EYEGLASS LENS PROCESSING APPARATUS

CROSS REFERENCE TO RELATED APPLICATION

This application is based upon and claims the benefit of priority of Japanese Patent Application No. 2013-006094 filed on Jan. 17, 2013, the contents of which are incorporated herein by reference in its entirety.

BACKGROUND

The present invention relates to an eyeglass lens processing apparatus that processes a periphery of an eyeglass lens.

In general, an eyeglass lens processing apparatus has a lens chuck shaft which holds an eyeglass lens, a processing tool rotational shaft to which processing tools (roughing tool, finishing tool, and the like) that process a periphery of the lens are attached and a shaft-to-shaft distance change mechanism which changes a shaft-to-shaft distance between the lens chuck shaft and the processing tool rotational shaft to move the lens relative to a processing tool side direction. The eyeglass lens processing apparatus controls rotations of the lens chuck shaft and controls the shaft-to-shaft distance change mechanism to process the periphery of the lens based on an input target lens shape.

As the shaft-to-shaft distance change mechanism, there are known methods such as a first method (referred to JP-A-2002-205251) which utilizes biasing portion such as a spring to generate a processing pressure onto a carriage that holds the lens chuck shaft when being pressed to a processing tool side, and a second method (referred to JP-A-2004-255561) which directly generates the processing pressure by driving a motor that moves the carriage to the processing tool side without using the biasing portion.

In a mechanism by the first method, the carriage holding the lens chuck shaft is movable along a guide shaft of the shaft-to-shaft distance change mechanism in a processing tool direction. However, a position in the processing tool direction is limited by a guide block that is moved by the motor. Then, the carriage can freely move against a biasing force of the biasing portion in a direction of being away from the guide block. For this reason, in the mechanism by the first method, there is provided a processing end detector which detects whether or not the carriage has reached a position of the guide block.

In a mechanism by the second method, linear movement conversion mechanisms such as a feed screw and a feed nut are moved in a shaft-to-shaft distance direction by the motor to cause the carriage to directly move in the shaft-to-shaft distance direction, and thus, it is possible to control the shaft-to-shaft distance without using the processing end detector. In addition, in the mechanism by the second method, a servomotor including a rotation detector as the motor that changes the shaft-to-shaft distance is used, and thus, it is possible to verify the processing pressure during processing.

SUMMARY

A mechanism by the first method does not need any special controlling and has an advantage in that a processing pressure does not mechanically exceed a certain level by biasing portion such as a spring. However, there is a disadvantage in the mechanism by the first method in that it is not possible to verify the processing pressure while processing a lens.

A mechanism by the second method needs to use a servomotor including a rotation detector, thereby causing a high cost. In addition, since the mechanism detects the processing pressure through a feed screw, there occurs a difference in the processing pressure between a shaft-to-shaft distance direction of being narrowed and a shaft-to-shaft distance direction of being widened, thereby being unlikely to acquire sufficient accuracy.

In consideration of the above-described apparatuses in the related art, the present invention technically aims to simplify an apparatus configuration and to provide an eyeglass lens processing apparatus of which the processing pressure during the lens processing can be accurately verified.

To solve the above-described problems, the present invention includes configurations as follows.

(1) An eyeglass lens processing apparatus comprising:

a lens chuck shaft configured to hold an eyeglass lens;

a lens rotation unit configured to rotate the lens chuck shaft;

a processing tool rotational shaft to which a processing tool for processing a periphery of the lens is attached;

a shaft-to-shaft distance change unit that includes:

a motor;

a carriage which holds one of the lens chuck shaft and the processing tool rotational shaft and is movable in a direction where a shaft-to-shaft distance between the lens chuck shaft and the processing tool rotational shaft changes by driving the motor;

a movement member that is moved in the shaft-to-shaft distance direction by driving the motor;

a connection member that connects the movement member and the carriage; and a deformation detecting sensor that is provided in the connection member and detects a deformation of the connection member in the shaft-to-shaft distance direction; and a controller configured to control the lens rotation unit and the shaft-to-shaft distance change unit to process the periphery of the lens using the processing tool based on an input target lens shape, the controller controlling the driving of the motor based on a detection result of the deformation detecting sensor.

(2) The eyeglass lens processing apparatus according to (1), wherein the shaft-to-shaft distance change unit includes a biasing portion configured to apply a processing pressure to press the lens held on the lens chuck shaft to the processing tool, and the controller obtains the processing pressure that is loaded between the lens and the processing tool based on a biasing force of the biasing portion and the detection result of the deformation detecting sensor, and controls the driving of the motor so that the obtained processing pressure does not exceed a set value.

(3) The eyeglass lens processing apparatus according to (2), wherein if the obtained processing pressure reaches the set value, the controller controls the driving of the motor so as to widen the shaft-to-shaft distance.

(4) The eyeglass lens processing apparatus according to (2), wherein the set value is set to a value that varies depending on a processing stage of roughing and finishing.

(5) The eyeglass lens processing apparatus according to (2), wherein the set value is set to a value that varies depending on a material of the lens.

(6) The eyeglass lens processing apparatus according to (1), wherein the controller performs a processing end determination for determining whether or not the shaft-to-shaft distance reaches a distance corresponding to a target shape of the lens for each rotational angle of the lens based on the detection result of the deformation detecting sensor.

(7) The eyeglass lens processing apparatus according to (1), wherein the shaft-to-shaft distance change unit includes a linear movement conversion mechanism that converts rotational driving of the motor to a linear movement to move the carriage in the shaft-to-shaft distance direction, and the movement member is provided in the linear movement conversion mechanism.

DESCRIPTION OF EXEMPLARY EMBODIMENTS

Figure 1:
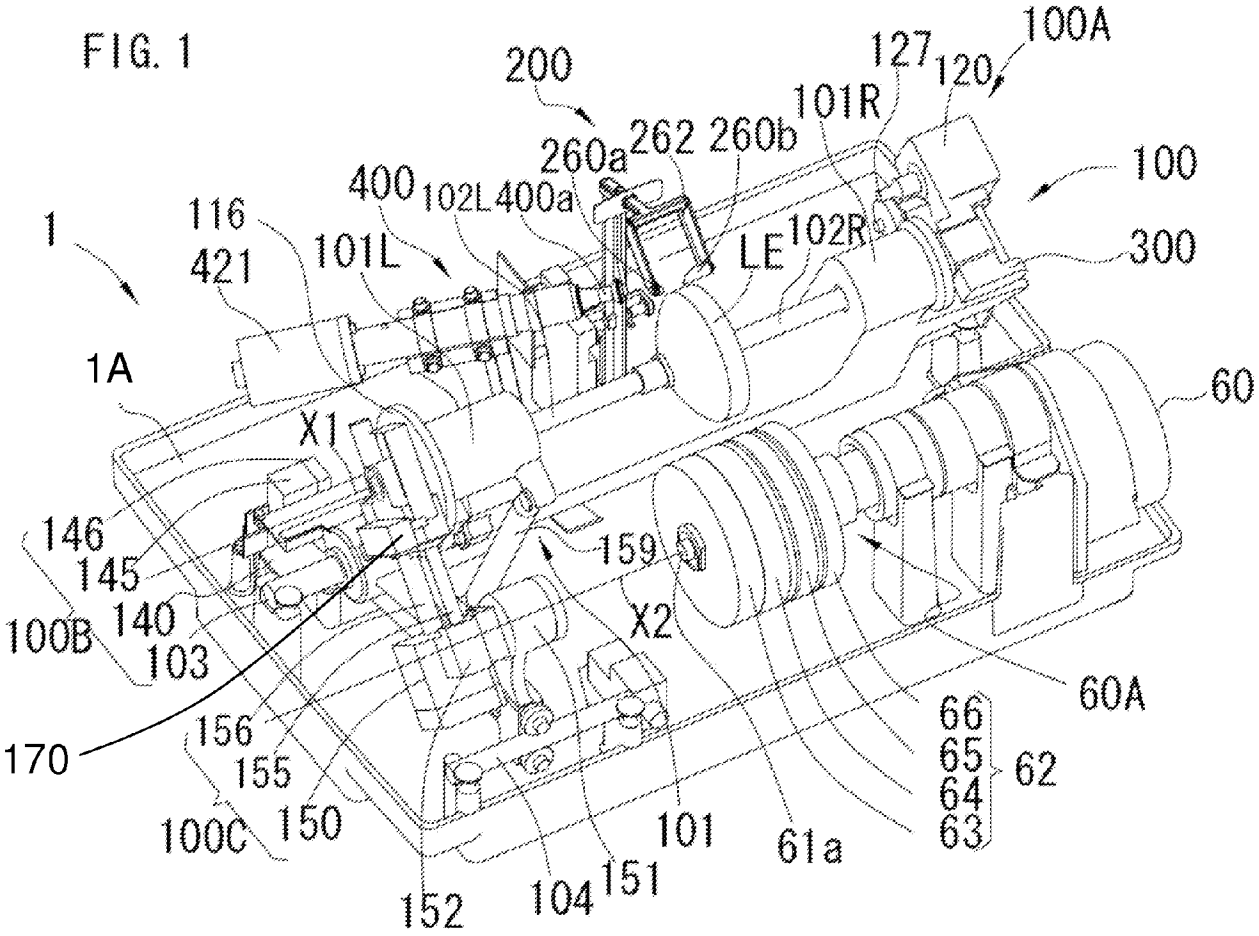
FIG. 1 is a schematic configuration view of processing mechanism portion of an eyeglass lens processing apparatus.
Figure 2:
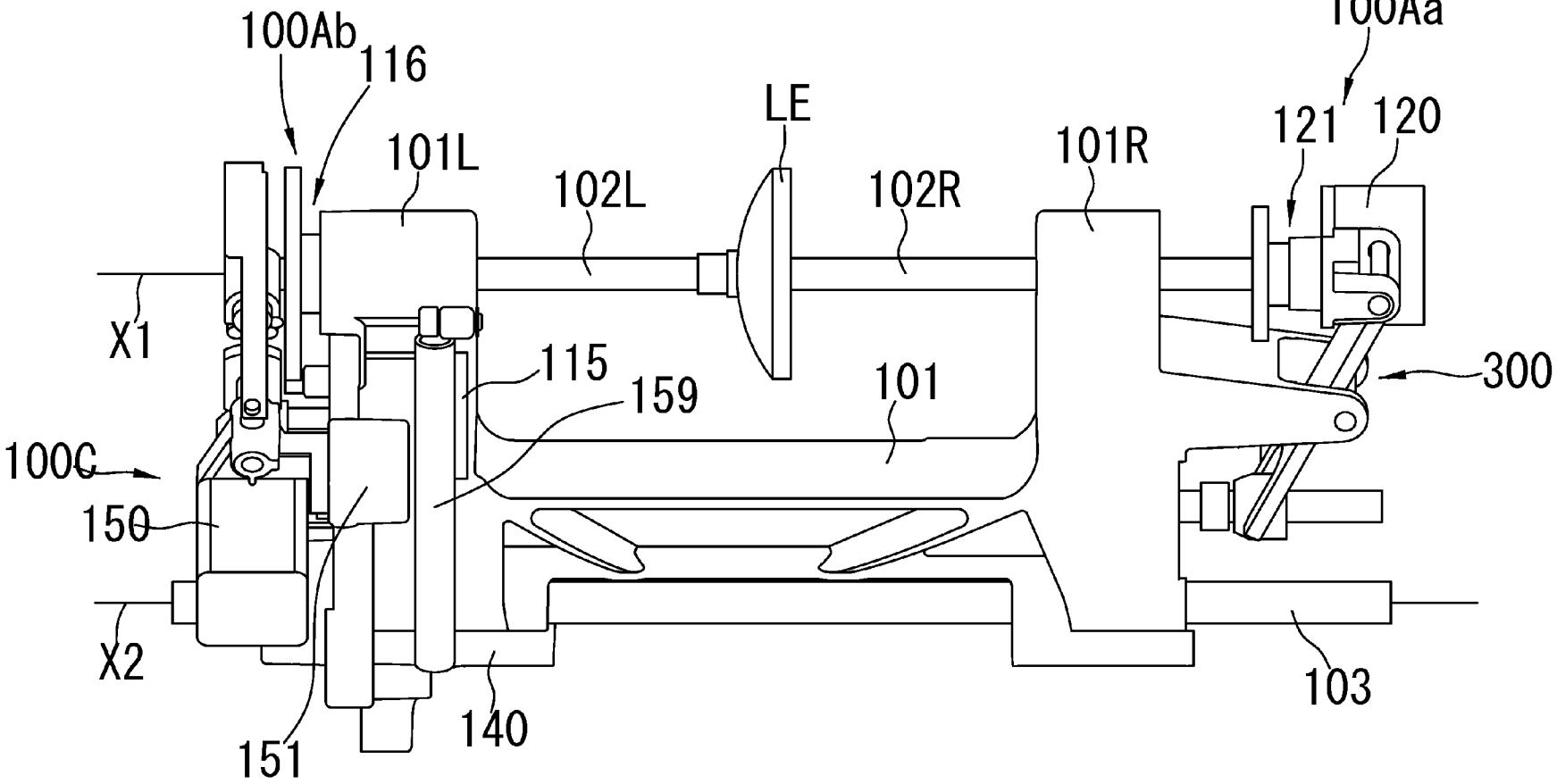
FIG. 2 is a view in which a lens holding portion is viewed from the front of the eyeglass lens processing apparatus.

Hereinafter, an embodiment according to the invention will be described with reference to the drawings. FIG. 1 is a schematic configuration view of a processing mechanism portion of an eyeglass lens processing apparatus. FIG. 2 is a view in which a lens holding portion 100 is viewed from the front (worker side) of the apparatus.

A processing apparatus main body 1 is provided with the lens holding portion 100 having a pair of lens chuck shafts 102L and 102R that hold a lens LE to be processed, a lens shape measurement unit 200 including a tracing stylus 260 that measures a shape (front surface and rear surface of the lens) of a refractive surface of the lens LE, and a processing tool rotation unit 60A rotating a processing tool rotational shaft 61*a* to which a processing tool 62 that processes a periphery of the lens LE is attached.

The lens holding portion 100 is provided with a lens rotation unit 100A, an X direction movement unit (chuck shaft movement unit) 100B, a Y direction movement unit (shaft-to-shaft distance change unit) 100C, and a lens chuck unit 300.

The lens rotation unit 100A (first rotation unit 100Aa, second rotation unit 100Ab) is used to rotate the pair of lens chuck shafts 102L and 102R. The X direction movement unit 100B is used to move the lens chuck shafts 102L and 102R in an X direction where a shaft line X1 of the lens chuck shafts 102L and 102R extends. The X direction movement unit 100B may be a mechanism rather to move the processing tool rotational shaft 61*a* (processing tool 168) in the X direction. The Y direction movement unit 100C has a carriage 101 that hold the lens chuck shafts 102L and 102R and the processing tool rotational shaft 61*a*. The carriage 101 is enabled to move by driving a motor 150 in a direction (Y direction) where a shaft-to-shaft distance between the lens chuck shafts 102L and 102R and the processing tool rotational shaft 61*a* changes. The Y direction movement unit 100C is used to move the lens chuck shafts 102L and 102R relative to the processing tool rotational shaft 61*a* in the direction where the shaft-to-shaft distance between the lens chuck shafts 102L and 102R and the processing tool rotational shaft 61*a* changes. The lens chuck unit 300, in order to interpose the lens LE, is used to move the lens chuck shaft 102R on one side with respect to the lens chuck shaft 102L on the other side toward the lens chuck shaft 102L side.

Hereinafter, an example of the processing apparatus main body 1 will be described in detail. The lens holding portion 100 and the processing tool rotation unit 60A are mounted on a main body base 1A of the processing apparatus main body 1.

The lens holding portion 100 has carriage 101 holding the lens chuck shafts 102L and 102R. The carriage 101 has a first arm 101L that rotatably holds the lens chuck shaft 102L and a second arm 101R that rotatably holds the lens chuck shaft 102R to be movable in the X direction (direction of shaft line X1). The lens chuck shaft 102R is moved to the lens chuck shaft 102L side by the lens chuck unit 300. In accordance with a movement of the lens chuck shaft 102R, the lens LE is held (chucked) between two of the lens chuck shafts 102R and 102L. Since a known mechanism is used for the lens chuck unit 300, descriptions thereof will be omitted.

<Lens Rotation Unit>

The lens rotation unit 100A is provided with the lens rotation unit 100Aa that rotates the lens chuck shaft 102R, and the lens rotation unit 100Ab that rotates the lens chuck shaft 102L. The lens rotation unit 100Aa is provided with a motor 120 that is attached to the lens chuck unit 300 and a rotation transfer mechanism 121. In addition, the lens rotation unit 100Ab has a motor 115 (not illustrated in FIG. 1) that is attached to the first arm 101L and a rotation transfer mechanism 116. The motors 120 and 115 are synchronized and rotated, and thus, the lens chuck shafts 102R and 102L are simultaneously rotated. As the lens rotation unit 100A, both of the lens chuck shafts 102R and 102L may be configured to rotate simultaneously via a known rotation transfer mechanism by one motor.

<X Direction Movement Unit>

The carriage 101 is mounted on an X movement support base 140 that is movable in the X direction along shafts 103 and 104 extending to be parallel to the shaft line X1 of the lens chuck shafts 102R and 102L and a shaft line X2 of the processing tool rotational shaft. A motor 145 is disposed on the main body base 1A. The X movement support base 140 is moved in the X direction by driving the motor 145 via a sliding mechanism such as a ball screw and a nut. If the X movement support base 140 is moved in the X direction, the lens chuck shafts 102R and 102L held by the carriage 101 are moved in the X direction. An encoder 146, which is a detector detecting the movement of the lens chuck shafts 102R and 102L in the X direction, is provided on a rotational shaft of the motor 145.

<Y Direction Movement Unit>

Figure 3:
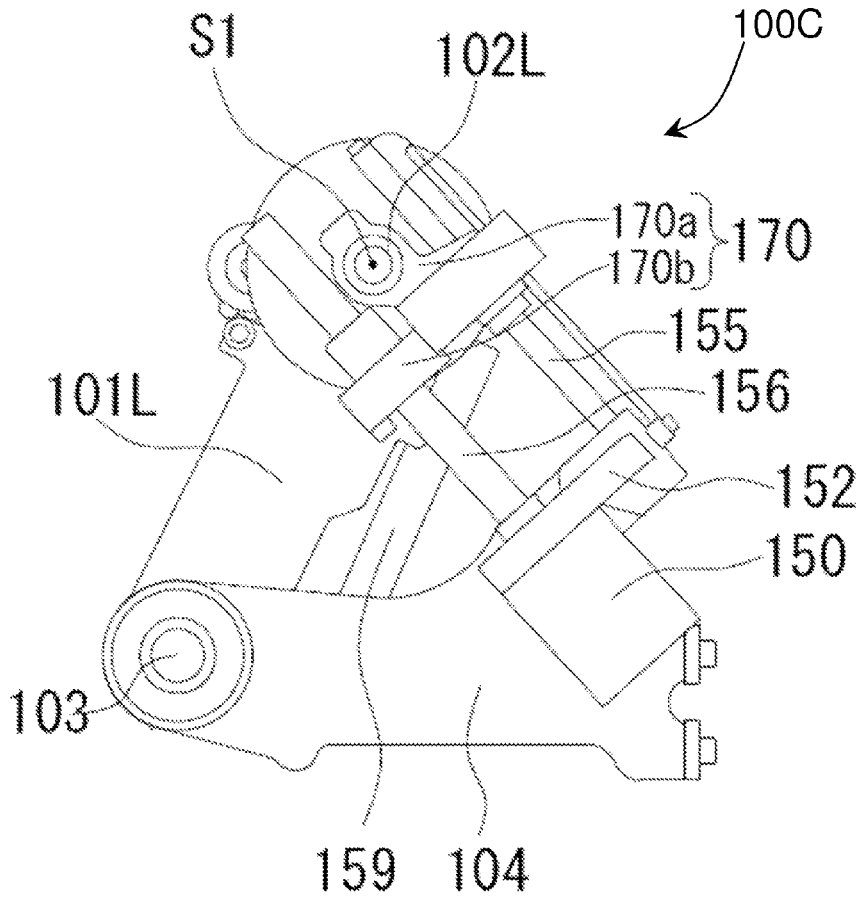
FIG. 3 is a view in which a Y direction movement unit is viewed from a left side of the apparatus.
Figure 4:
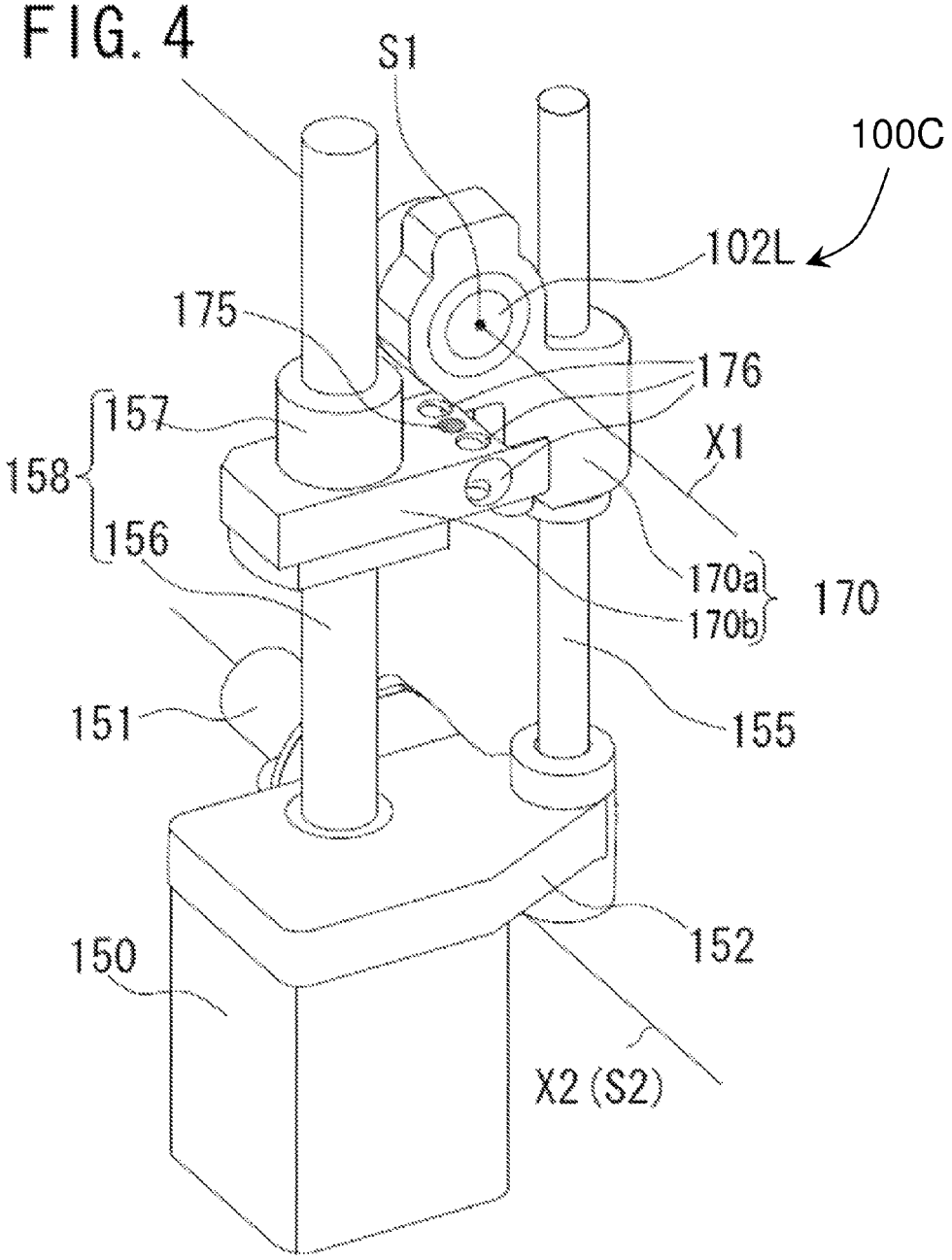
FIG. 4 is a configuration view of a main portion of a shaft-to-shaft distance movement mechanism included in the Y direction movement unit.

A preferable configuration example of the Y direction movement unit 100C will be described based on FIGS. 1 to 4. FIG. 3 is a view in which the Y direction movement unit 100C is viewed from a left side of the apparatus 1. FIG. 4 is a configuration view of a main portion of a shaft-to-shaft distance movement mechanism included in the Y direction movement unit 100C.

The carriage 101 (first arm 101L and second arm 101R) is provided on the X movement support base 140 being rotatable (swingable) about a shaft line of the shaft 103. If the first arm 101L and the second arm 101R of the carriage 101 rotate about the shaft line of the shaft 103, the lens chuck shafts 102R and 102L held on the tip side of the first arm 101L and the second arm 101R are moved in the Y direction about the shaft line of the shaft 103. A spring 159 is disposed between the movement support base 140 and the tip side of the first arm 101L as biasing portion. Pulling spring force of the spring 159 pulls the first arm 101L and the second arm 101R of the carriage 101 in a direction of the processing tool 62. That is, the lens chuck shafts 102R and 102L are pulled in the direction of the processing tool 62 by the spring 159 so as to apply a processing pressure that presses the lens LE against the processing tool 62.

The X movement support base 140 is formed to be extended from the shaft 103 to the shaft 104 in front thereof. A swing block 152, being rotatable about the shaft line X2 of the processing tool rotational shaft 61*a*, is attached to a bearing portion 151 that is provided in front of the X movement support base 140. According to the embodiment, a rotational center S2 of the swing block 152 coincides with the shaft line X2. The motor 150 is attached to the swing block 152 to move the carriage 101 (lens chuck shafts 102R and 102L) in the Y direction. A pulse motor is used as the motor 150. A linear movement conversion mechanism 158 is provided in the Y direction movement unit 100C to convert rotational driving of the motor 150 to a linear movement (straight movement) of the carriage 101 in a shaft-to-shaft distance direction (direction connecting lens chuck shaft 102L and 102R and processing tool rotational shaft 61*a*). The linear movement conversion mechanism 158 according to the embodiment includes a ball screw 156, which is attached to a rotational shaft of the motor 150, and a nut (movement member) 157 engaging with the ball screw 156. The ball screw 156 extends to be parallel to the direction connecting the shaft line X1 and the shaft line X2. The nut 157 that is the movement member is directly moved in the shaft-to-shaft distance direction by driving the motor 150. The ball screw 156 and the nut 157 of the linear movement conversion mechanism 158 may be configured to be reversely disposed so that the nut 157 rotates by the motor 150 and the ball screw 156 is directly moved in the shaft-to-shaft distance direction as the movement member. In addition, a guide shaft 155 extending to be parallel to the ball screw 156 is fixed to the swing block 152.

Meanwhile, a connection block (connection member) 170 made of metal is provided in the first arm 101L of the carriage 101 being rotatable about a rotational center S1. According to the embodiment, the rotational center of the connection block 170 is configured to coincide with the shaft line of the lens chuck shaft 102R. In addition, the connection block 170 is configured to include a first connection block 170*a* to which the guide shaft 155 is slidably connected and a second connection block 170*b* which is connected to the nut 157, a movement member. The first connection block 170*a* and the second connection block 170*b* are integrally fixed to each other by a fixing tool such as a screw. The first connection block 170*a* and the second connection block 170*b* may be configured in an integrated member. In addition, the movement member (nut 157) and the connection block 170 may be configured to be integrated.

If the ball screw 156 rotates by the motor 150, the connection block 170 fixed to the nut 157 is moved in a shaft direction of the ball screw 156 and the guide shaft 155. Then, if the connection block 170 is moved in the shaft direction of the ball screw 156, the first arm 101L and the second arm 101R of the carriage 101 rotate about the shaft center of the shaft 103, and the lens chuck shafts 102R and 102L are moved in the Y direction.

According to the embodiment, there are provided the rotational center S1 of the connection block 170 to coincide with the shaft line X1 of the lens chuck shaft 102R and the rotational center S2 of the swing block 152 to coincide with the shaft line X2 of the processing tool rotational shaft 61*a*. However, the invention is not limited thereto. As long as the rotational center S1 of the connection block 170 and the rotational center S2 of the swing block 152 are positioned to be parallel to the direction connecting the shaft line X1 and the shaft line X2, the rotational centers may be provided at a position away from the shaft line X1 and the shaft line X2.

According to the embodiment, the carriage 101 is a swing-type (method in which arm holding lens chuck shaft is moved in arc) rotating about the shaft 103. However, the invention is not limited thereto. The carriage 101 may have a linear movement-type configuration linearly moving in the direction connecting the lens chuck shafts 102R and 102L and the processing tool rotational shaft 61*a*. In a case of the linear movement-type configuration, a mechanism that rotatably holds the connection block 170 is omitted, and thus, the connection block 170 is fixedly disposed on the arm 101L (101R) of the carriage 101. In addition, a mechanism that rotatably holds the swing block 152 is also omitted, and thus, the ball screw 156 and the motor 150 are fixedly disposed on the X movement support base 140.

Here, a deformation detecting sensor 175 that detects a deformation of the connection block 170 in the shaft-to-shaft distance direction connecting the lens chuck shaft and the processing tool rotational shaft is disposed in the connection block 170. It is preferable for the deformation detecting sensor 175 to be a strain gauge capable of detecting a minute deformation. As the deformation detecting sensor 175, it is possible to use a load cell (pressure detection element) or a piezoelectric element. It is preferable that the deformation detecting sensor 175 be disposed at a location where the connection block 170 is likely deformed, thereby being disposed at a location between a connection portion (rotational center S1) of the carriage 101 and a connection portion of the ball screw 156 to which a movement force is applied by the motor 150. According to the embodiment, the deformation detecting sensor is disposed in the second connection block 170*b*. A plurality of holes 176 are formed in the second connection block 170*b* in the vicinity of the deformation detecting sensor 175, thereby securing connection strength of the connection block 170 and having the structure that enables the deformation detecting sensor 175 to detect a minute deformation. Any material may be used for the connection block 170 as long as the material can secure the connection strength. A detection signal from the deformation detecting sensor 175 is input to a control portion 50 described below. The control portion 50, based on a detected signal of the deformation detecting sensor 175, obtains a load (processing pressure) that is generated between the processing tool 62 and the lens LE while processing the periphery of the lens.

In the Y direction movement unit 100C, the carriage 101 holds the lens chuck shafts 102R and 102L so as to move to the processing tool rotational shaft 61*a* side. However, the invention is not limited thereto. The carriage 101 may be configured to hold the processing tool rotational shaft 61*a* so that the carriage 101 is moved to the lens chuck shafts 102R and 102L sides.

<Lens Shape Measurement Unit>

In FIG. 1, above the carriage 101, that is, at a position in the opposite direction with respect to the lens processing tool 168 via the carriage 101, the lens shape measurement unit 200 that measures a shape of a front refractive surface and a shape of rear refractive surface of the lens is provided. As the tracing stylus 260, the lens shape measurement unit 200 includes a tracing stylus 260*a* that is brought into contact with a front surface of the lens LE and a tracing stylus 260*b* that is brought into contact with a rear surface of the lens LE. A tip of the tracing styli 260*a* and 260*b* is disposed to a position on a moving path of the lens chuck shafts 102R and 102L in the Y direction. The tracing styli 260*a* and 260*b* are held by an arm 262 being movable in the X direction. The lens shape measurement unit 200 has a sensor 257 (referred to FIG. 5) that detects a movement position of the tracing styli 260*a* and 260*b* in the X direction via the arm 262.

When measuring a lens shape, the lens LE is rotated by rotating the lens chuck shafts 102R and 102L, and movements of the lens chuck shafts 102R and 102L in the Y direction are controlled based on a target lens shape, and thus, the position of the front surface and the rear surface of the lens in the X direction corresponding to the target lens shape is detected by the sensor 257. According to the apparatus, a movement control of the lens chuck shafts 102R and 102L in the X direction is also utilized to perform the shape measurement of the front surface and the rear surface of the lens.

<Processing Tool Rotation Unit>

On the base portion 1A, the processing tool rotation unit 60A is disposed on a side facing (opposite to) the lens shape measurement unit 200 interposing the carriage 101 therebetween. The processing tool rotation unit 60A has a motor 60 that rotates the processing tool rotational shaft 61*a*. The processing tool 62 that processes the periphery of the lens LE is attached to the processing tool rotational shaft 61*a*. The processing tool 62 is configured to include a grindstone 63 for a glass roughing, a finishing grindstone 64 having a V-shaped groove (bevel groove) that forms a bevel on the lens and having a flat-processed surface, a flat-finishing grindstone 65, and grindstone 66 for a plastic roughing. The lens LE interposed (chucked) between the lens chuck shafts 102L and 102R that are included in the carriage 101 is pressed against the processing tool 62, thereby processing the periphery of the lens LE by the processing tool 62.

On the base portion 1A, a second lens processing tool unit 400, one of the processing tools is provided on a side facing (opposite to) the processing tool rotation unit 60A interposing the carriage 101 therebetween. The second lens processing tool unit 400 includes a chamfering grindstone 431 that is attached to a processing tool rotational shaft 400*a* and a grooving grindstone 432. The processing tool rotational shaft 400*a* rotates by a motor 421. The periphery of the lens LE to be processed which is pinched between the lens chuck shafts 102L and 102R is processed by the processing tools 431 and 432 of the lens processing tool unit 400.

<Electrical Configuration>

Figure 5:
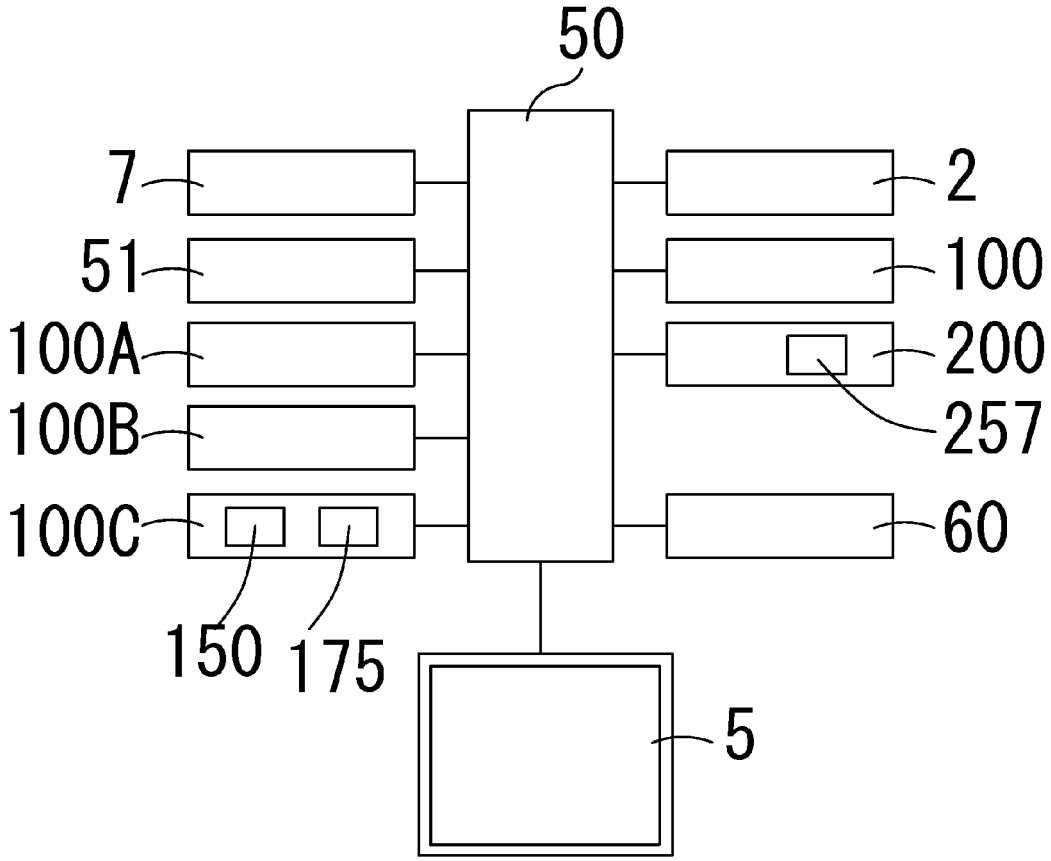
FIG. 5 is a block diagram describing an electrical configuration of the eyeglass lens processing apparatus.

FIG. 5 is a block diagram describing an electrical configuration of the eyeglass lens processing apparatus. The control portion (controller) 50 is connected to a switch portion 7, a memory 51, electrical configuration elements of the carriage 101 (such as motor, sensor), the lens shape measurement unit 200, and a touch panel-type display 5 as display means and input means. The control portion 50 receives an input signal using a touch panel function of the display 5 and controls displaying of figures and information of the display 5. In addition, herein, an eyeglass frame shape measurement portion 2 (disclosure of JP-A-4-93164 can be utilized) is connected to the eyeglass lens periphery processing apparatus. Data of the target lens shape obtained in the eyeglass frame shape measurement portion 2 is input through a switch operation of the switch portion 7.

<Control Operation>

Next, in the eyeglass lens processing apparatus having the above-described configuration, a control operation in the Y direction during the lens processing will be mainly described.

A shape of the periphery of the eyeglass frame is measured by the eyeglass frame shape measurement portion 2. The data of the measured target lens shape in a periphery shape is input through an operation of a predetermined switch of the switch portion 7 by an operator, thereby being stored in the memory 51. If the data of the target lens shape is input, a figure of the target lens shape is displayed on the display 5. The operator operates a predetermined switch provided in the display 5, and thus, it is possible to input layout data such as a pupillary distance (PD value) of a wearer, frame pupillary distance (FPD value) of an eyeglass frame, and a height of an optical center of the target lens shape with respect to a geometrical center. In addition, a worker can designate a position (whether to set to the geometrical center of the target lens shape or set to the optical center of the lens LE) of a chuck center (processing center) of the lens LE with respect to the target lens shape by operating the switch of the display 5. Accordingly, the input data of the target lens shape is converted into the data of the target lens shape (length of radius vector rn, angle of radius vector θn) (n=1, 2, . . . , N) based on the chuck center.

In addition, the display 5 is provided with a switch that inputs material information (plastic, polycarbonate, glass, or the like) of the lens, a switch that inputs frame type information (metal, celluloid, or the like), and a switch that inputs a processing condition such as a processing mode (beveling, flat-processing, polish-finishing, or groove-finishing).

After inputting the data necessary for the processing is completed, the worker arranges the lens LE to be held by the lens chuck shafts 102L and 102R. If a start switch of the switch portion 7 is pressed, a series of operations relating to the processing is started. Firstly, the refractive surface shape of the lens LE is measured.

The control portion 50 drives the lens shape measurement unit 200 and obtains the shape data of the front surface and the rear surface of the lens LE corresponding to the target lens shape. If the shape data of the front surface and the rear surface of the lens LE is obtained, a thickness of the lens (thickness of edge) corresponding to the target lens shape can be obtained.

After measuring the lens shape is completed, the stage is shifted to the roughing. For example, if the plastic as the material for the lens is input, a roughing tool (roughing grindstone 66) is applied in the roughing stage. The control portion 50 controls driving of the motor 145 of the X direction movement unit 100B and moves the lens chuck shafts 102R and 102L in the X direction so as to position the lens LE on the roughing grindstone 66. Sequentially, the control portion 50 drives the motor 120 to rotate the lens LE while controlling the driving of the Y direction movement unit 100C (motor 150) based on the target lens shape data (length of radius vector rn, angle of radius vector θn) (n=1, 2, . . . , N). Furthermore, as changing the shaft-to-shaft distance for each rotational angle of the lens LE, the lens LE is pressed against the roughing grindstone 66, thereby performing the roughing of the periphery of the lens LE. When processing this periphery, the control portion 50 obtains the processing pressure (load) that is applied between the lens and the processing tool based on a detection result of the deformation detecting sensor 175 and controls the driving of the motor 150 so as to cause the obtained processing pressure not to exceed a predetermined set value. Hereinafter, a control of the Y direction movement unit 100C will be described in detail.

The carriage 101 is pulled to the processing tool 62 side by the biasing force of the spring 159. The biasing force (pressure) of the spring 159 is referred to as PA. The biasing force PA is a known value and stored in the memory 51. The connection block 170 is moved to the processing tool 62 side by driving the motor 150. Accordingly, both the carriage 101 and the lens LE are moved to the processing tool 62 side. At this time, the deformation of the connection block 170 is detected by the deformation detecting sensor 175, and thus, the detected signal of the deformation detecting sensor 175 allows the pressure applied to the connection block 170 to be acquired. The pressure applied to the connection block 170 is referred to as a measurement pressure PB. If the lens LE is not in a state of being in contact with the processing tool 62, the measurement pressure PB applied to the connection block 170 becomes equal to the biasing force PA (PB=PA).

If the carriage 101 is moved to the processing tool 62 side, and if the lens LE is pressed against the processing tool 62 (roughing grindstone 66 when roughing), there occurs a processing pressure PC that is applied between the lens LE and the processing tool 62. At this time, since the measurement pressure PB that can be acquired by the deformation detecting sensor 175 becomes PB=PA−PC, it is possible to obtain the processing pressure PC by an arithmetic (PC=PA−PC). Accordingly, it is possible to verify the processing pressure during the lens processing, thereby enabling the lens LE to be appropriately processed. The carriage 101 is moved in both directions of the shaft-to-shaft distance between the lens chuck shafts 102L and 102R and the processing tool rotational shaft 61*a* to be narrow and wide. However, it is possible to accurately verify the processing pressure in both directions during the lens processing based on the detection result of the deformation detecting sensor 175.

While processing the lens, the control portion 50 controls the driving of the motor 150 so as to cause the processing pressure PC not to exceed a set value PS that is set in advance. For example, if the processing pressure PC reaches the set value PS, the control portion 50 drives the motor 150 so as to widen the shaft-to-shaft distance. Accordingly, the processing pressure applied to the lens LE during the processing is prevented from being excessive, and misalignment (phenomenon of rotational angle of lens LE being misaligned with respect to rotational angle of the lens chuck shaft) of the lens LE is suppressed from being generated, thereby enabling the lens LE to be appropriately processed.

The control data (processing data) of the shaft-to-shaft distance during the roughing is obtained based on a processing path that is calculated by adding a predetermined lens margin allowed for finishing to the length of the radius vector rn of the target lens shape. In addition, the shaft-to-shaft distance during the lens processing can be controlled using a pulse number that is instructed to the motor (pulse motor) 150 by the control portion 50. Then, the control portion 50 determines whether or not the periphery of the lens LE is processed up to the processing path that is a target shape (that is, whether or not shaft-to-shaft distance has reached a distance corresponding to target shape of lens) to end the processing based on the detection result of the deformation detecting sensor 175. This determination of a processing end is performed, for example, based on whether or not the processing pressure PC is equal to or below the reference value PE for the processing end that is set in advance. In addition, the control portion 50 performs this determination of the processing end for each rotational angle of the lens LE. If the processing pressure PC is equal to or below the reference value PE for the processing end at all the rotational angles on a whole circumference of the lens LE, the roughing on the whole circumference is completed.

After the roughing stage is completed, the stage is shifted to the finishing. The control portion 50 controls the driving of the X direction movement unit 100B and positions the lens LE on the finishing grindstone 64 that is a finishing tool. Thereafter, the lens LE is rotated while the driving of the Y direction movement unit 100C (motor 150) is controlled based on the target lens shape data. Then, as changing the shaft-to-shaft distance for each rotational angle of the lens LE, the lens LE is pressed against the finishing grindstone 64, thereby performing the finishing of the periphery of the lens LE. In this finishing stage as well, the driving of the motor 150 is controlled so as to cause the processing pressure PC that is obtained based on the detection result of the deformation detecting sensor 175 not to exceed the set value PS that is set in advance. In addition, the control portion 50 determines the processing end based on whether or not the processing pressure PC is equal to or below the reference value PE for the processing end that is set in advance. In addition, the control portion 50 determines the processing end for each rotational angle of the lens LE based on the detection result of the deformation detecting sensor 175. If the processing pressure PC is equal to or below the reference value PE for the processing end at all the rotational angles on the whole circumference of the lens LE, the finishing on the whole circumference is completed.

The set value PS and the reference value PE for the processing end described above may be set to a value that differs in accordance with a processing stage (roughing stage, finishing stage, and the like). PS and PE can be designated with an appropriate value by testing in each processing stage. In addition, the set value PS and the reference value PE for the processing end may be set to a value that differs in accordance with a lens material input through the display 5, that is, input means. For example, in a case of the lens material being glass while a case thereof is plastic, the set value PS and the reference value PE for the processing end are set high.

As above, the processing pressure PC while processing the lens LE based on the detection result of the deformation detecting sensor 175 can be acquired, and it is possible to process the lens LE precisely and appropriately based on the processing pressure.

What is claimed is:

1. An eyeglass lens processing apparatus comprising:

a lens chuck shaft configured to hold an eyeglass lens;

a lens rotation unit configured to rotate the lens chuck shaft;

a processing tool rotational shaft to which a processing tool for processing a periphery of the lens is attached;

a shaft-to-shaft distance change unit that includes:

a motor;

a carriage which holds one of the lens chuck shaft and the processing tool rotational shaft and is movable in a direction where a shaft-to-shaft distance between the lens chuck shaft and the processing tool rotational shaft changes by driving the motor;

a movement member that is moved in the shaft-to-shaft distance direction by driving the motor;

a connection member that connects the movement member and the carriage; and a deformation detecting sensor that is provided in the connection member and is configured to detect a deformation of the connection member in the shaft-to-shaft distance direction; and a controller configured to control the lens rotation unit and the shaft-to-shaft distance change unit to process the periphery of the lens using the processing tool based on an input target lens shape, the controller controlling the driving of the motor based on a detection result of the deformation detecting sensor.

2. The eyeglass lens processing apparatus according to claim 1, wherein the shaft-to-shaft distance change unit includes a biasing portion configured to apply a processing pressure to press the lens held on the lens chuck shaft to the processing tool, and the controller obtains the processing pressure that is loaded between the lens and the processing tool based on a biasing force of the biasing portion and the detection result of the deformation detecting sensor, and controls the driving of the motor so that the obtained processing pressure does not exceed a set value.

3. The eyeglass lens processing apparatus according to claim 2, wherein if the obtained processing pressure reaches the set value, the controller controls the driving of the motor so as to widen the shaft-to-shaft distance.

4. The eyeglass lens processing apparatus according to claim 2, wherein the set value is set to a value that varies depending on a processing stage of roughing and finishing.

5. The eyeglass lens processing apparatus according to claim 2, wherein the set value is set to a value that varies depending on a material of the lens.

6. The eyeglass lens processing apparatus according to claim 1, wherein the controller performs a processing end determination for determining whether or not the shaft-to-shaft distance reaches a distance corresponding to a target shape of the lens for each rotational angle of the lens based on the detection result of the deformation detecting sensor.

7. The eyeglass lens processing apparatus according to claim 1, wherein the shaft-to-shaft distance change unit includes a linear movement conversion mechanism that converts rotational driving of the motor to a linear movement to move the carriage in the shaft-to-shaft distance direction, and the movement member is provided in the linear movement conversion mechanism.

* * * * *